United States Patent [19]

Jones et al.

[11] 3,958,991

[45] May 25, 1976

[54] SUPERSENSITIZING DYE COMBINATION FOR ELECTROPHOTOGRAPHIC COMPOSITION AND ELEMENT

[75] Inventors: Jean Elmore Jones; William Edward Yoerger, both of Rochester, N.Y.

[73] Assignee: Eastman Kodak Company, Rochester, N.Y.

[22] Filed: Aug. 7, 1974

[21] Appl. No.: 495,365

Related U.S. Application Data

[63] Continuation of Ser. No. 261,881, June 12, 1972, now Defensive Publication No. T0909009.

[52] U.S. Cl. ..... 96/1.6; 252/501

[51] Int. Cl.[2] ..... G03G 5/09

[58] Field of Search ..... 96/1.6; 252/501

[56] References Cited

UNITED STATES PATENTS

| | | | |
|---|---|---|---|
| 3,554,745 | 1/1971 | Van Allan | 96/1.6 |
| 3,796,569 | 3/1974 | Kondo et al. | 96/1.6 |
| 3,796,573 | 3/1974 | Jones | 96/1.6 |
| 3,814,600 | 6/1974 | Contois | 96/1.6 |

*Primary Examiner*—David Klein
*Assistant Examiner*—Judson R. Hightower
*Attorney, Agent, or Firm*—J. G. Levitt

[57] ABSTRACT

This invention relates to supersensitizing dye combinations useful for organic photoconductive compositions comprising: at least one cyanine, merocyanine, rhodacyanine or styryl spectral sensitizing dye which 1. has an anodic polarographic half-wave potential less than +1.0 volts;
2. has an anodic polarographic half-wave potential and a cathodic polarographic half-wave potential which, when added together, give a sum more negative than −0.10 volts; and
3. desensitizes negative silver bromide emulsions, containing 99.35 mole percent bromide, less than 0.4 log E at radiation of 365 nm. when incorporated therein at a concentration of 0.2 millimole of dye per mole of silver halide; and at least one electron-accepting dye such as a pyrylium or thiapyrylium salt as the supersensitizer.

8 Claims, No Drawings

SUPERSENSITIZING DYE COMBINATION FOR ELECTROPHOTOGRAPHIC COMPOSITION AND ELEMENT

This is a continuation of Ser. No. 261,881, filed June 12, 1972, now Defensive Publication No. T0909009, published Apr. 3, 1973.

This invention relates to organic compounds useful as supersensitizers in photoconductive compositions and electrophotographic elements.

The process of xerography, as disclosed by Carlson in U.S. Pat. No. 2,297,691, employs an electrophotographic element comprising a support material bearing a coating of a normally insulating material whose electrical resistance varies with the amount of incident actinic radiation it receives during an imagewise exposure. The element, commonly termed a photoconductive element, is first given a uniform surface charge after a suitable period of dark adaptation. The element is then exposed to a pattern of actinic radiation which has the effect of differentially reducing the potential of the surface charge in accordance with the relative energy contained in various parts of the radiation pattern. The differential surface charge or electrostatic latent image remaining on the electrophotographic element is then made visible by contacting the surface with a suitable electroscopic marking material. Such marking material or toner, whether contained in an insulating liquid or on a dry carrier, can be deposited on the exposed surface in accordance with either the charge pattern or in the absence of charge pattern as desired. The deposited marking material can then be either permanently fixed to the surface of the sensitive element by known means such as heat, pressure, solvent vapor and the like or transferred to a second element to which it may similarly be fixed. Likewise, the electrostatic latent image can be transferred to a second element and developed there.

Various photoconductive insulating materials have been employed in the manufacture of electrophotographic elements. For example, vapors of selenium and vapors of selenium alloys deposited on a suitable support and particles of photoconductive zinc oxide held in a resinous, film-forming binder have found wide application in present-day document copying applications.

Since the introduction of electrophotography, a great many organic compounds have been found to possess some degree of photoconductivity. Many organic compounds such as trinitrofluorenone have revealed a useful level of photoconduction and have been incorporated into photoconductive compositions. Optically clear organic photoconductor-containing elements having desirable electrophotographic properties can be especially useful in electrophotography. Such electrophotographic elements may be exposed through a transparent base, if desired, thereby providing unusual flexibility in equipment design. Such compositions when coated as a film or layer on a suitable support also yield an element which is reusable; that is, it can be used to form subsequent images after residual toner from prior images has been removed by transfer and/or cleaning.

Although many of the organic photoconductive materials are inherently light sensitive, their degree of sensitivity is usually low so that it is often necessary to add materials to increase their speed. Increasing the electrophotographic speed has several advantages in that it reduces exposure time, allows projection printing through various optical systems, etc. By increasing the speed through the use of sensitizers, photoconductors which would otherwise have been unsatisfactory are useful in processes where higher speeds are required. Accordingly, there is a need for a new material useful as sensitizers of organic photoconductor-containing systems.

One object of this invention is to provide a novel supersensitizing dye combination for organic photoconductors.

Another object of this invention is to provide supersensitized organic photoconductor compositions.

A further object of this invention is to provide a novel electrophotographic material, including a conductive support having coated thereon an insulating layer containing a supersensitizing dye combination.

Still another object of this invention will be apparent from the following disclosure and the appended claims.

In accordance with this invention, novel compositions of matter are provided, comprising organic photoconductors and a supersensitizing dye combination defined more fully below. These compositions can be incorporated in a suitable binder and coated on a conductive support for use in electrophotographic process.

Polyarylalkane photoconductors are particularly useful according to the present invention. Such photoconductors are described in U.S. Pat. No. 3,274,000; French Pat. No. 1,383,461, and Seus and Goldman Belgian Pat. No. 696,114, granted Sept. 25, 1967. These photoconductors include leucobases of diaryl or triaryl methane dye salts, 1,1,1-triarylalkanes wherein the alkane moiety has at least two carbon atoms and tetraarylmethanes, there being substituted an amine group on at least one of the aryl groups attached to the alkane and methane moieties of the latter two classes of photoconductors which are non-leuco base materials.

Preferred polyaryl alkane photoconductors can be represented by the formula:

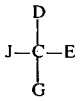

wherein each of D, E and G is an aryl group and J is a hydrogen atom, an alkyl group, or an aryl group, at least one of D, E and G containing an amino substituent. The aryl groups attached to the central carbon atom are preferably phenyl groups, although naphthyl groups can also be used. Such aryl groups can contain such substituents as alkyl and alkoxy typically having 1 to 8 carbon atoms, hydroxy, halogen etc. in the ortho, meta or para positions, ortho-substituted phenyl being preferred. The aryl groups can also be joined together or cyclized to form a fluorene moiety, for example. The amino substituent can be represented by the formula

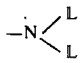

wherein each L can be an alkyl group typically having 1 to 8 carbon atoms, a hydrogen atom, an aryl group, or together the necessary atoms to form a heterocyclic amino group typically having 5 to 6 atoms in the ring such as morpholino, pyridyl, pyrryl, etc.. At least one of D, E, and G is preferably a p-dialkylaminophenyl group. When J is an alkyl group, such an alkyl group more generally has 1 to 7 carbon atoms.

Representative useful polyarylalkane photoconductors include the compounds listed below:

| Compound Number | |
|---|---|
| (1) | 4′,4″-bis(diethylamino)-2′,2″-dimethyltriphenylmethane |
| (2) | 4′,4″-diamino-4-dimethylamino-2′,2″-dimethyltriphenylmethane |
| (3) | 4′,4″-bis(diethylamino)-2,6-dichloro-2′,2″-dimethyltriphenylmethane |
| (4) | 4′,4″-bis(diethylamino)-2′,2″-dimethyldiphenylnaphthylmethane |
| (5) | 2′,2″-dimethyl-4,4′,4″-tris(dimethylamino) triphenylmethane |
| (6) | 4′,4″-bis(diethylamino)-4-dimethylamino-2′,2″-dimethyltriphenylmethane |
| (7) | 4′,4″-bis(diethylamino)-2-chloro-2′,2″-dimethyl-4-dimethylaminotriphenylmethane |
| (8) | 4′,5″-bis(diethylamino)-4-dimethylamino-2,2′-2″-trimethyltriphenylmethane |
| (9) | 4′,4′-bis(dimethylamino)-2-chloro-2′,2″-dimethyltriphenylmethane |
| (10) | 4′,4″-bis(dimethylamino)-2′,2″-dimethyl-4-methoxytriphenylmethane |
| (11) | 4′,4″-bis(benzylethylamino)-2′,2″-dimethyltriphenylmethane |
| (12) | 4′,4″-bis(diethylamino)-2′,2″-diethoxytriphenylmethane |
| (13) | 4,4′-bis(dimethylamino)-1,1,1-triphenylethane |
| (14) | 1-(4-N,N-dimethylaminophenyl)-1,1-diphenylethane |
| (15) | 4-dimethylaminotetraphenylmethane |
| (16) | 4-diethylaminotetraphenylmethane |

As described herein, a wide variety of photoconductor compounds such as arylamines and diarylamino-substituted chalcones can be spectrally sensitized with the dyes referred to herein. Some organic photoconductors will, of course, be preferred to others; but in general useful results may be obtained from substantially all of the presently known organic photoconductors.

The following comprises a partial listing of patents showing such organic photoconductors and compositions which can be used in place of those more particularly described herein.

TABLE I

| Inventor | Issued | Patent Numbers |
|---|---|---|
| Noe et al | Feb. 25, 1964 | 3,122,435 |
| Sus et al | March 31, 1964 | 3,127,266 |
| Schlesinger | April 21, 1964 | 3,130,046 |
| Cassiers | April 28, 1964 | 3,131,060 |
| Schlesinger | June 30, 1964 | 3,139,338 |
| Schlesinger | June 30, 1964 | 3,139,339 |
| Cassiers | July 14, 1964 | 3,140,946 |
| Davis | | |
| Ghys | Sept. 15, 1964 | 3,148,982 |
| Cassiers | Nov. 3, 1964 | 3,155,503 |
| Cassiers | Nov. 24, 1964 | 3,158,475 |
| Tomanek | Dec. 15, 1964 | 3,161,505 |
| Schlesinger | Dec. 29, 1964 | 3,163,530 |
| Schlesinger | Dec. 29, 1964 | 3,163,531 |
| Schlesinger | Dec. 29, 1964 | 3,163,532 |
| Hoegl | Feb. 9, 1965 | 3,169,060 |
| Stumpf | March 23, 1965 | 3,174,854 |
| Klupfel et al | April 27, 1965 | 3,180,729 |
| Klupfel et al | April 27, 1965 | 3,180,730 |
| Neugebauer | June 15, 1965 | 3,189,447 |
| Neugebauer | Sept. 14, 1965 | 3,206,306 |
| Davis et al | July 21, 1964 | 3,141,770 |
| Hoegl et al | June 5, 1962 | 3,037,861 |
| Sus et al | June 26, 1962 | 3,041,165 |
| Schlesinger | Nov. 27, 1962 | 3,066,023 |
| Bethe | Jan. 8, 1963 | 3,072,479 |
| Klupfel et al | July 9, 1963 | 3,047,095 |
| Neugebauer et al | Nov. 26, 1963 | 3,112,197 |
| Cassiers et al | Dec. 3, 1963 | 3,113,022 |
| Schlesinger | Dec. 17, 1963 | 3,114,633 |

The organic photoconductors are sensitized with a supersensitizing combination of dyes comprising: at least one cyanine, merocyanine, rhodacyanine or styryl spectral sensitizing dye which 1. has an anodic polarographic half-wave potential less than +1.0 volts;
2. has an anodic polarographic half-wave potential and a cathodic polarographic half-wave potential which, when added together, gives a sum more negative than −0.10 volts; and
3. desensitizes negative silver bromoiodide emulsions, containing 99.35 mole percent bromide, less than 0.4 log E at radiation of 365 nm. when incorporated therein at a concentration of 0.2 millimole of dye per mole of silver halide;

and at least one electron accepting dye as the supersensitizer.

Electron accepting dyes, for example, the pyrylium and thiapyrylium salts as disclosed in Davis et al, U.S. Pat. No. 3,141,770 issued July 21, 1964, and in Van Allen et al, U.S. Pat. No. 3,250,615 issued May 10, 1966, have been found to be especially useful supersensitizing compounds for the organic photoconductive compositions of this invention. In addition, it has been found that certain individual species of pyrylium salts may advantageously be used in combination to provide improved supersensitivity effects in particular regions of the spectrum such as the far red and near infrared region of the spectrum. Contois et al, U.S. Pat. No. 3,586,500 issued June 22, 1971, and Contois U.S. Pat. No. 3,577,235 issued May 4, 1971, list suitable individual species. Other species of pyrylium salts which have been found to be useful as supersensitizers for the photoconductive compositions are disclosed in VanAllan, U.S. Pat. No. 3,554,745, issued Jan. 12, 1971. Other species of pyrylium salt sensitizers found to be useful in any supersensitizing combination are disclosed in Defensive Publications Nos. T889,021; T889,022; and T889,023, all issued on Aug. 31, 1971. Still other species of pyrylium salt sensitizers are disclosed in Belgian Pat. No. 754,066 dated Sept. 30, 1970.

Exemplary of the spectral sensitizing dyes useful in the supersensitizing combination are the following:

TABLE II

Dye

A 3,3′-diethyl-9-methylthiacarbocyanine bromide

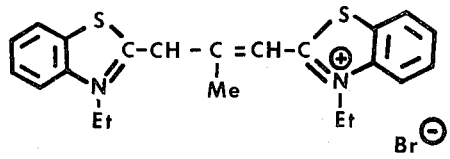

B 5-(3-ethyl-2-benzoxazylididene ethylidene)-3-ethyl rhodanine

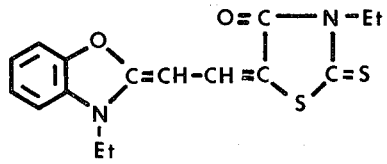

C 1,1′-diethyl-2,2′-cyanine bromide

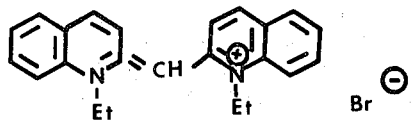

TABLE II-continued

Dye

D 2-diphenylamino-(3-ethyl(3H)benzothiazolylidine ethylidene)-4(5)thiazolone

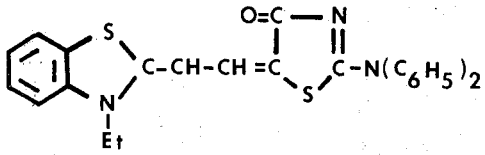

E 5,5',6,6'-tetrachloro-1,1',3,3'-tetraethylbenzimidazolocarbocyanine bromide

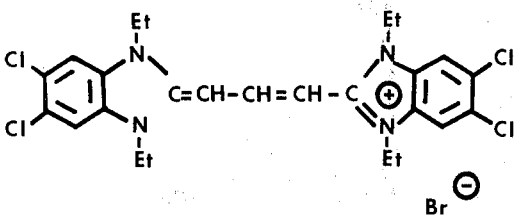

F 3-ethyl-5-[(3-ethyl-2-benzothiazolinylidene)-1-methylethylidene]-2-thio-2,4-oxazolidinedione

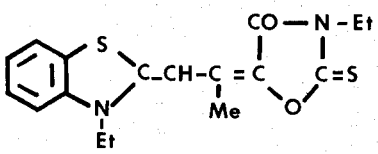

G 2-(3,3-dicyanoallylidene)-3-ethylbenzothiazoline

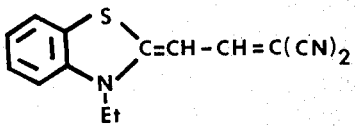

H 2-(5,5-dicyano-2,4-pentadienylidene)-3-ethylbenzothiazoline

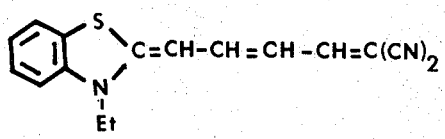

I 3-ethyl-5-(1-ethyl-4(1H)-pyryidylidene)rhodanine

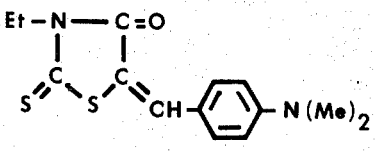

J 3,3'-diethyloxacarbocyanine iodide

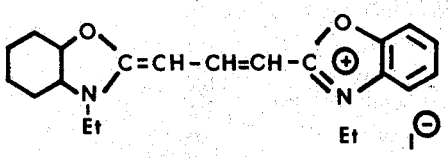

K 5-[(3-ethyl-2(3)-benzoxazolylidene)ethylidene]-3-heptyl-2-thio-2,4(3,5)-oxazolidine

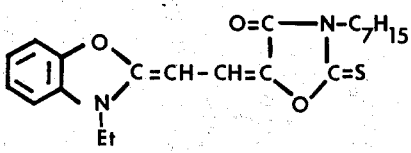

L 3-ethyl-5-[(3-methyl-2-thiazolidinylidene)ethylidene]-2-thio-2,4-oxazolidinedione TABLE II-continued Dye

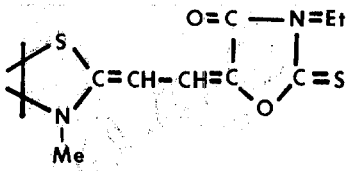

M 3-ethyl-5-(2-ethyl-1-benzothiazylidene)rhodanine

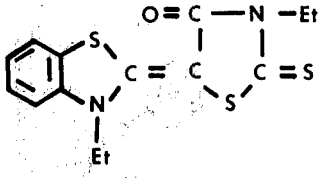

N 1,3-diethyl-5-[(1,3-diethyl-2(3)-benzimidazolylidene)-ethylidene]-2-thiobarbituric acid

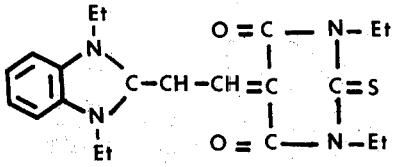

O 5-(3-ethyl-2-benzothiazylidene ethylidene)-3-ethyl rhodanine

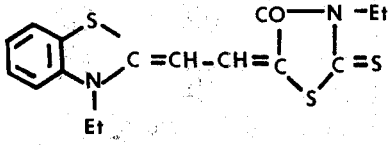

P 3,3'-diethylthiadicarbocyanine iodide

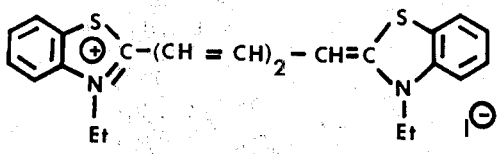

Exemplary of the electron-accepting dyes useful in the supersensitizing combination are the following:

TABLE III

Dye

I 4-(n-butylamino-2-(4-methoxyphenyl)benzo[b]-pyrylium perchlorate

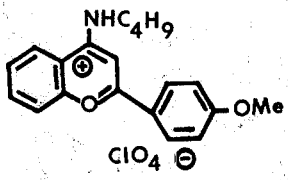

II 4-methoxy-2-(4-methoxyphenyl)benzo[b]pyrylium perchlorate

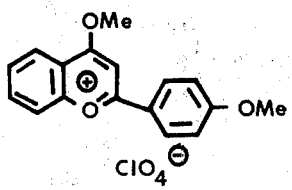

III 2-ethyl-3-phenylnaphtho[2,1-b]pyrylium perchlorate

TABLE III-continued

| Dye | |
|---|---|
| 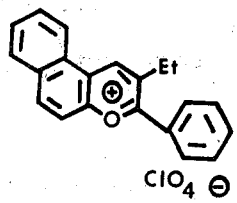 | |
| IV | 2,6-diphenylpyrylium perchlorate |
| 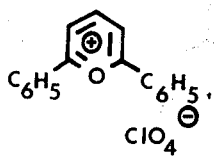 | |
| V | 2-phenylpyrylium perchlorate |
| 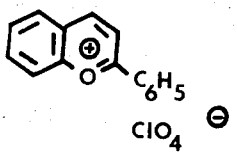 | |
| VI | 2,6-diphenyl-4-hydroxypyrylium perchlorate |
| 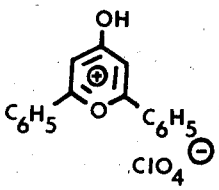 | |
| VII | 4-(4-dimethylamino-3,5-dimethylphenyl)-2,6-diphenylpyrylium perchlorate |
| 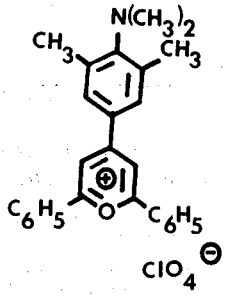 | |
| VIII | 4-anilino-2-phenylbenzo[b]pyrylium perchlorate |
| 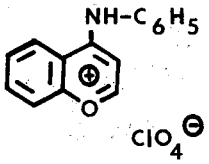 | |
| IX | 4-benzylamino-2-phenylbenzo[b]pyrylium perchlorate |
| 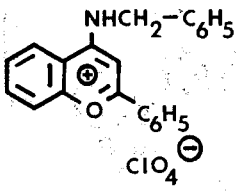 | |
| X | 4-hydroxy-2-phenylbenzo[b]pyrylium perchlorate |

TABLE III-continued

| Dye | |
|---|---|
| 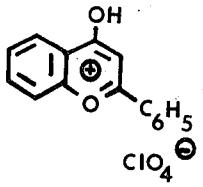 | |
| XI | 4-(2,4-dichlorophenyl)-2,6-diphenylthiapyrylium perchlorate |
| 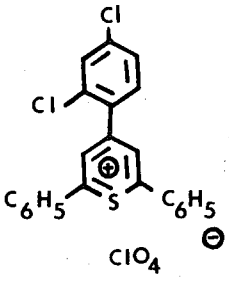 | |
| XII | 4-anilino-2-(4-methoxyphenyl)benzo[b]pyrylium perchlorate |
| 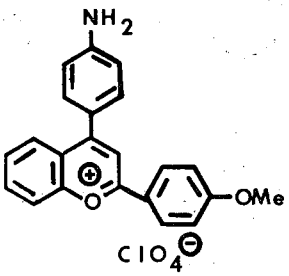 | |
| XIII | 2-(4-methoxyphenyl)-4-(1-piperidino)benzo[b]-pyrylium perchlorate |
| 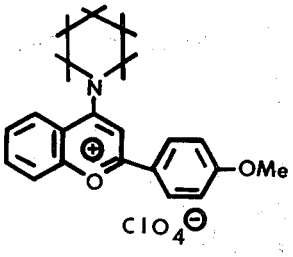 | |
| XIV | 4-(4-ethoxynaphth-1-yl)-2-(4-methoxyphenyl)-benzo[b]pyrylium perchlorate |
| 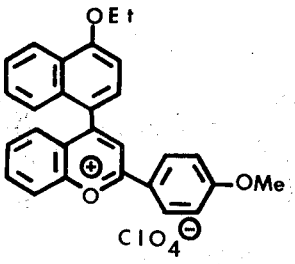 | |
| XV | 2-(4-methoxyphenyl)-4-methylmercaptobenzo[b]-pyrylium perchlorate |
| 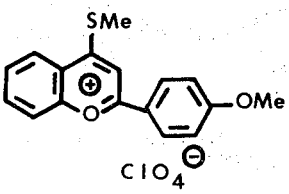 | |

TABLE III-continued

| Dye | |
|---|---|
| XVI | 2-(4-methoxyphenyl)benzo[b]pyrylium perchlorate |
| | 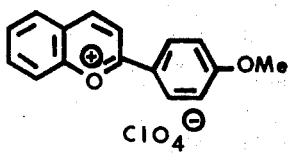 |
| XVII | 4-chloro-2-(4-methoxyphenyl)benzo[b]pyrylium perchlorate |
| | 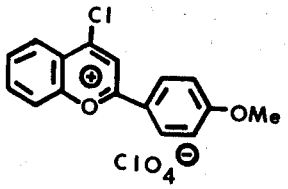 |
| XVIII | 4-methoxy-2-phenylbenzo[b]pyrylium perchlorate |
| | 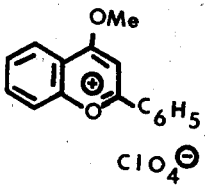 |
| XIX | 2,4-diphenyl-5,6,7,8,9,10-hexahydrocycloocta [b]pyrylium perchlorate |
| | 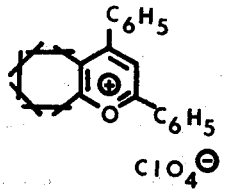 |
| XX | 1-(n-butylamino)-3-phenylnaphtho[2,1-b ]pyrylium perchlorate |
| | 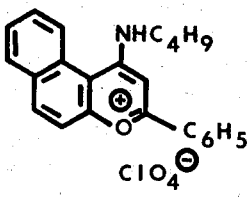 |
| XXI | 2-chloro-2-phenylnaphtho[2,1-b]pyrylium perchlorate |
| | 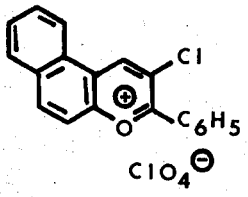 |
| XXII | 2-methyl-3-phenylnaphtho[2,1-b]pyrylium perchlorate |
| | 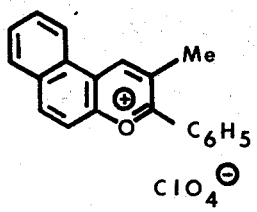 |

TABLE III-continued

| Dye | |
|---|---|
| XXIII | 4-(4-iodophenyl)-2,6-diphenylthiapyrylium perchlorate |
| | 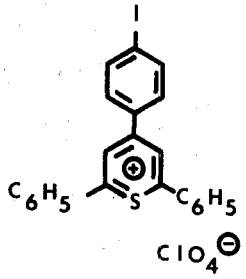 |
| XXIV | 4-butylamino-2-(2,4-dimethoxyphenyl)benzo[b] pyrylium perchlorate |
| | 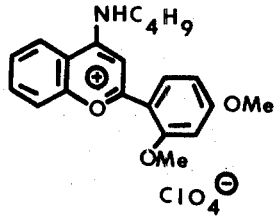 |
| XXV | 4-(4-nitrostyryl)flavylium perchlorate |
| | 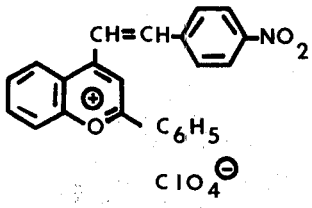 |
| XXVI | 4-(n-butylamino)-2,6-diphenylpyrylium perchlorate |
| | 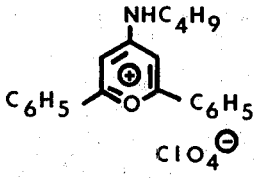 |
| XXVII | 4-(n-butylamino)-2-phenylbenzo[b]thiapyrylium perchlorate |
| | 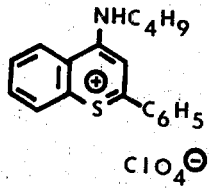 |
| XXVIII | 4-(phenethylamino)-2-phenylbenzo[b]thiapyrylium perchlorate |
| | 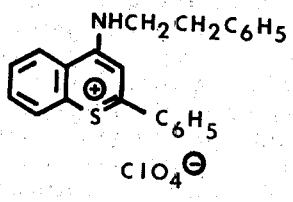 |
| XXIX | 2-phenyl-4-(n-tetradecylamino)benzo[b]thiapyrylium perchlorate |
| | 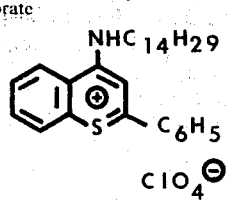 |

TABLE III-continued

| Dye | |
|---|---|
| XXX | 4-benzylamino-2-phenylbenzo[b]thiapyrylium perchlorate |
| | 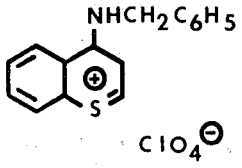 |
| XXXI | 2,3-diphenylnaphtho[2,1-b]pyrylium perchlorate |
| | 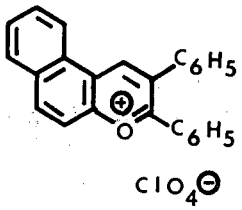 |
| XXXII | 2,6-dimethyl-4-(1-piperidyl)pyrylium perchlorate |
| | 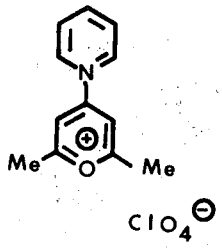 |
| XXXIII | 4-(N-n-Butylamino)-2-(4-methoxyphenyl)naphtho-[1,2-b]pyrylium perchlorate |
| | 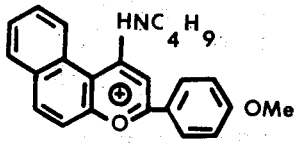 |

The supersensitized organic photoconductor compositions of this invention can, in certain arrangements, be employed in electrophotographic elements in the absence of binder. For example, the photoconductor itself is sometimes capable of film formation, and therefore requires no separate binder. An example of such film-forming photoconductor is poly(vinylcarbazole). However, the more common arrangement is to provide a binder for the supersensitized organic photoconductive materials. Any suitable binder material may be utilized for the supersensitized organic photoconductors of the invention. Such binders should possess high dielectric strength, and have good insulating properties (at least in the absence of actinic radiation) as well as good film forming properties. Preferred binder materials are polymers such as polystyrene, poly(methylstyrene), styrenebutadiene polymers, poly(vinyl chloride), poly(vinylidene chloride), poly(vinyl acetate), vinyl acetate-vinyl chloride polymers, poly(vinyl acetals), polyacrylic and methacrylic acid esters, polyesters such as poly(ethylene alkaryloxy-alkylene terephthalates), phenol-formaldehyde resins, polyamides, polycarbonates and the like.

Electrically conductive supports useful in the practice of our invention may be selected from any of those which are useful in electrophotographic processes, such as metal plates or foils, metal foils laminated to paper or plastic films, electrically conductive papers and films, papers and films coated with transparent electrically conductive resins, and the like. Whether a transparent, translucent or opaque support material is used will be determined by the method of exposure to be employed, e.g., by reflex or by transmission through the original, and by the end use to which the reproduction is to be put. Exposure by reflex, for example, requires that the support transmit light while no such requirement is necessary for exposures by projection. Similarly, transparent supports are required if the reproduction is to be used for projection purposes; translucent supports are preferred for reflex prints; and opaque supports are adequate if the image is subsequently transferred by any means to another support, the reproduction is satisfactory as obtained, or the reproduction is to be used as a printing plate for preparing multiple copies of the original.

The quantity of the above-described dye required to supersensitize an organic photoconductor varies with the results desired, the particular dye used, and the particular organic photoconductor used. Generally speaking, good results are obtained with about 0.01 to 20 parts by weight spectral sensitizing dye and about 0.01 to 10 parts by weight electron-accepting dye with 1 to 75 parts by weight of the organic photoconductor. Binder can be employed in such compositions, when desired, at preferred ranges of 25 to 99 parts by weight.

The supersensitizing combination of dyes results in a substantial improvement in sensitivity of the spectral sensitizing dye with a resultant increase in speed of an electrophotographic system.

The following example is included for a further understanding of the invention.

EXAMPLE I

A series of photoconductive compositions containing the organic photoconductor 4′,4″-bis(diethylamino)-2′,2″-dimethyltriphenylmethane as the photoconductive material are prepared for coating on a conducting support material by mixing 0.25 parts of the photoconductor with 0.01 parts by weight of either the spectral sensitizer or supersensitizing electron-accepting dye and then dissolving the mixture with 1.0 parts by weight resinous polyester binder, in the solvent dichloromethane.

The resultant mixture is then hand coated over a polymeric carboxy ester lactone layer carried on a transparent support. In all instances, the polyester binder in the coating composition is Vitel PE-101 (trademark of Goodyear Tire and Rubber Co.) and is believed to be poly (4,4′-isopropylidene-bisphenoxy ethyl-co-ethylene terephthalate) 50/50. The wet coating thickness on the support is 0.004 inch. After drying, a sample of each electrophotographic element is employed in a standard xerographic process which includes charging under a positive corona discharge until the surface potential of the sample, as measured by an electrometer probe, reaches about 600 volts. Each of the samples is then exposed from behind a transparent stepped density gray scale to a 3000°K tungsten source of 20 foot-candle illuminance at the point of exposure.

The exposure causes reduction of surface potential of the element under each step of the gray scale from its initial potential, Vo, to some lower potential, V, the exact value of which depends upon the actual amount of exposure received by each area. The results of these measurements are then plotted on a graph of surface potential, V, versus log exposure for each step. The actual speed of each element can then be expressed in terms of the reciprocal of the exposure required to reduce the surface potential to any fixed arbitrarily assigned value with the results indicated in Table IV.

TABLE IV

| | Spectral Sensitizing Dye | | Spectral Sensitizing Dye + Supersensitizing Dye I | |
|---|---|---|---|---|
| Dye | $V_o$ | Positive Speed $V_o$-100V | $V_o$ | Positive Speed $V_o$-100V |
| None | 600 | 12 | 600 | 120 |
| B | 580 | 80 | 600 | 320 |
| C | 640 | 8 | 660 | 250 |
| D | 600 | 270 | 580 | 450 |
| E | 660 | 12 | 600 | 200 |
| F | 640 | 25 | 560 | 220 |
| G | 660 | 25 | 630 | 280 |
| H | 600 | 14 | 600 | 400 |
| J | 600 | 20 | 580 | 200 |
| K | 660 | 32 | 650 | 210 |
| L | 600 | 32 | 600 | 320 |
| M | 600 | 28 | 580 | 320 |
| N | 620 | 18 | 660 | 270 |
| O | 580 | 18 | 600 | 200 |
| P | 600 | 23 | 600 | 300 |

The invention has been described in detail with particular reference to certain preferred embodiments thereof, but it will be understood that variations and modifications can be effected within the spirit and scope of the invention.

We claim:

1. A photoconductive composition comprising an organic photoconductor selected from the group consisting of arylamine, polyarylalkane and diarylamino-substituted chalcone photoconductors sensitized with a supersensitizing combination comprising (a) a cyanine, merocyanine, rhodacyanine or styryl spectral sensitizing dye wherein said dye 1. has an anodic polarographic half-wave potential less than +1.0 volts;
2. has an anodic polarographic half-wave potential and a cathodic polarographic half-wave potential which, when added together, give a sum more negative than −0.10 volts; and
3. desensitizes negative silver bromoiodide emulsions, containing 99.35 mole percent bromide, less than 0.4 log E at radiation of 365 nm. when incorporated therein at a concentration of 0.2 millimole of dye per mole of silver halide; and (b) as a supersensitizer therefore, an electron accepting pyrylium or thiapyrylium dye salt.

2. A photoconductive composition as described in claim 1 wherein said composition comprises a mixture of an organic photoconductor and a film forming resin binder.

3. An electrophotographic element comprising a support having coated thereon a layer of a photoconductive composition comprising an organic photoconductor selected from the group consisting of arylamine, polyarylalkane and diarylamino-substituted chalcone photoconductors sensitized with a supersensitizing combination comprising (a) a cyanine, merocyanine, rhodacyanine or styryl spectral sensitizing dye wherein said dye 1. has an anodic polarographic half-wave potential less than +1.0 volts;
2. has an anodic polarographic half-wave potential and a cathodic polarographic half-wave potential which, when added together, give a sum more negative than −0.10 volts; and
3. desensitizes negative silver bromoiodide emulsions, containing 99.35 mole percent bromide, less than 0.4 log E at radiation of 365 nm. when incorporated therein at a concentration of 0.2 millimole of dye per mole of silver halide; and (b) as a supersensitizer therefore, an electron accepting pyrylium or thiapyrylium dye salt.

4. An element as in claim 3 wherein the photoconductive composition comprises a mixture of organic photoconductor and a film forming resin binder.

5. A photoconductive composition according to claim 1 wherein said spectral sensitizing dye is selected from the group consisting of:

3,3′-diethyl-9-methylthiacarbocyanine bromide;
5-(3-ethyl-2-benzoxazylididene ethylidene)-3-ethyl rhodanine;
1,1′-diethyl-2,2′-cyanine bromide;
2-diphenylamino-(3-ethyl(3H)benzothiazolylidine ethylidene)-4(5)thiazolone;
5,5′,6,6′-tetrachloro-1,1′,3,3′-tetraethylbenzimidazolocarbocyanine bromide;
3-ethyl-5-[(3-ethyl-2-benzothiazolinylidene)-1-methyl-ethylidene]-2-thio-2,4-oxazolidinedione;
2-(3,3-dicyanoallylidene)-3-ethylbenzothiazoline;
2-(5,5-dicyano-2,4-pentadienylidene)-3-ethylbenzothiazoline;
3-ethyl-5-(1-ethyl-4(1H)-pyryidylidene)rhodanine;
3,3′-diethyloxacarboxyanine iodide;
5-[(3-ethyl-2(3)-benzoxazolylidene)ethylidene]-3-heptyl-2-thio-2,4(3,5)-oxazolidine;
3-ethyl-5-[(3-methyl-2-thiazolidinylidene)ethylidene]-2-thio-2,4-oxazolidinedione;
3-ethyl-5-(2-ethyl-1-benzothiazylidene)rhodanine;
1,3-diethyl-5-[(1,3-diethyl-2(3)-benzimidazolylidene)-ethylidene]-2-thiobarbituric acid;
5-(3-ethyl-2-benzothiazylidene ethylidene)-3-ethyl rhodanine; and
3,3′-diethylthiadicarbocyanine iodide.

6. A photoconductive composition according to claim 1 wherein said electron accepting pyrylium or thiapyrylium dye salt is selected from the group consisting of:

4-(n-butylamino-2-(4-methoxyphenyl)benzo[b-]pyrylium salt;
4-methoxy-2-(4-methoxyphenyl)benzo[b]pyrylium salt;
2-ethyl-3-phenylnaphtho[2,1-b]pyrylium salt;
2,6-diphenylpyrylium salt;
2-diphenylpyrylium salt;
2,6-diphenyl-4-hydroxypyrylium salt;
4-(4-dimethylamino-3,5-dimethylphenyl)-2,6-diphenylpyrylium salt;
4-anilino-2-phenylbenzo[b]pyrylium salt;
4-benzylamino-2-phenylbenzo[b]pyrylium salt;
4-hydroxy-2-phenylbenzo[b]pyrylium salt;
4-(2,4-dichlorophenyl)-2,6-diphenylthiapyrylium salt;
4-anilino-2-(4-methoxyphenyl)benzo[b]pyrylium salt;
2-(4-methoxyphenyl)-4-(1-piperidino)benzo[b-]pyrylium salt;
4-(4-ethoxynapth-1-yl)-2-(4-methoxyphenyl)benzo[b]pyrylium salt;
2-(4-methoxyphenyl)-4-methylmercaptobenzo[b-]pyrylium salt;
2-(4-methoxyphenyl)benzo[b]pyrylium salt;
4-chloro-2-(4-methoxyphenyl)benzo[b]pyrylium salt;
4-methoxy-2-phenylbenzo[b]pyrylium salt;
2,4-diphenyl-5,6,7,8,9,10-hexahydrocycloocta[b-]pyrylium salt;
1-(n-butylamino)-3-phenylnaphtho[2,1-b]pyrylium salt;
2-chloro-2-phenylnaphtho[2,1-b]pyrylium salt;
2-methyl-3-phenylnaphtho[2,1-b]pyrylium salt;
4-(4-iodophenyl)-2,6-diphenylthiapyrylium salt;
4-butylamino-2-(2,4-dimethoxyphenyl)benzo[b-]pyrylium salt;
4-(4-nitrostyryl)flavylium salt;
4-(n-butylamino)-2,6-diphenylpyrylium salt;
4-(n-butylamino)-2-phenylbenzo[b]thiapyrylium salt;
4-(phenethylamino)-2-phenylbenzo[b]thiapyrylium salt;
2-phenyl-4-(n-tetradecylamino)benzo[b]-thiapyrylium salt;
4-benzylamino-2-phenylbenzo[b]thiapyrylium salt;
2,3-diphenylnaphtho[2,1-b]pyrylium salt;
2,6-dimethyl-4-(1-piperidyl)pyrylium salt; and 4-(N-n-butylamino)-2-(4-methoxyphenyl)naphtho[1,2-b]-pyrylium salt.

7. An element according to claim 3 wherein said spectral sensitizing dye is selected from the group consisting of:

3,3′-diethyl-9-methylthiacarbocyanine bromide;
5-(3-ethyl-2-benzoxyazylididene ethylidene)-3-ethyl rhodanine;
1,1′-diethyl-2,2′-cyanine bromide;
2-diphenylamino-(3-ethyl(3H)benzothiazolylidene ethylidene)-4(5)thiazolone;
5,5′,6,6′-tetrachloro-1,1′,3,3′-tetraethylbenzimidazolo-carbocyanine bromide;
3-ethyl-5-[(3-ethyl-2-benzothiazolinylidene)-1-methyl-ethylidene]-2-thio-2,4-oxazolidinedione;
2-(3,3-dicyanoallylidene)-3-ethylbenzothiazoline;
2-(5,5-dicyano-2,4-pentadienylidene)-3-ethylbenzothiazoline;
3-ethyl-5-(1-ethyl-4(1H)-pyridylidene)rhodanine;
3,3′-diethyloxacarbocyanine iodide;
5-[(3-ethyl-2(3)-benzoxazolylidene)ethylidene]-3-heptyl-2-thio-2,4(3,5)-oxazolidine;
3-ethyl-5-[(3-methyl-2-thiazolidinylidene)ethylidene]-2-thio-2,4-oxazolidinedione;
3-ethyl-5-(2-ethyl-1-benzothiazylidene)rhodanine;
1,3-diethyl-5-[(1,3-diethyl-2(3)-benzimidazolylidene)-ethylidene]-2-thiobarbituric acid;
5-(3-ethyl-2-benzothiazylidene ethylidene)-3-ethyl rhodanine; and
3,3′-diethylthiadicarbocyanine iodide.

8. An element according to claim 3 wherein said electron accepting pyrylium or thiapyrylium dye salt is selected from the group consisting of:

4-(n-butylamino-2-(4-methoxyphenyl)benzo[b-]pyrylium salt;
4-methoxy-2-(4-methoxyphenyl)benzo[b]pyrylium salt;
2-ethyl-3-phenylnaphtho[2,1-b]pyrylium salt;
2,6-diphenylpyrylium salt;
2-phenylpyrylium salt;
2,6-diphenyl-4-hydroxypyrylium salt;
4-(4-dimethylamino-3,5-dimethylphenyl)-2,6-diphenylpyrylium salt;
4-anilino-2-phenylbenzo[b]pyrylium salt;
4-benzylamino-2-phenylbenzo[b]pyrylium salt;
4-hydroxy-2-phenylbenzo[b]pyrylium salt;
4-(2,4-dichlorophenyl)-2,6-diphenylthiapyrylium salt;
4-anilino-2-(4-methoxyphenyl)benzo[b]pyrylium salt;
2-(4-methoxyphenyl)-4-(1-piperidino)[b]pyrylium salt;
4-(4-ethoxynaphth-1-yl)-2-(4-methoxyphenyl)benzo[b]pyrylium salt;
2-(4-methoxyphenyl)-4-methylmercaptobenzo[b-]pyrylium salt;
2-(4-methoxyphenyl)benzo[b]pyrylium salt;
4-chloro-2-(4-methoxyphenyl)benzo[b]pyrylium salt;
4-methoxy-2-phenylbenzo[b]pyrylium salt;
2,4-diphenyl-5,6,7,8,9,10-hexahydrocycloocta[b-]pyrylium salt;
1-(n-butylamino)-3-phenylnaphtho[2,1-b]pyrylium salt;
2-chloro-2-phenylnaphtho[2,1-b]pyrylium salt;
2-methyl-3-phenylnaphtho[2,1-b]pyrylium salt;
4-(4-iodiphenyl)-2,6-diphenylthiapyrylium salt;
4-butylamino-2-(2,4-dimethoxypheny)benzo[b-]pyrylium salt;
4-(4-nitrostyryl)flavylium salt;
4-(n-butylamino)-2,6-diphenylpyrylium salt;
4-(n-butylamino)-2-phenylbenzo[b]thiapyrylium salt;
4-(phenethylamino)-2-phenylbenzo[b]thiapyrylium salt;
2-phenyl-4-(n-tetradecylamino)benzo[b]-thiapyrylium salt;
4-benzylamino-2-phenylbenzo[b]thiapyrylium salt;
2,3-diphenylnaphtho[2,1-b]pyrylium salt;
2,6-dimethyl-4-(1-piperidyl)pyrylium salt; and
4-(N-butylamino)-2-(4-methoxyphenyl)naphtho[1,2-b]-pyrylium salt.

* * * * *

UNITED STATES PATENT AND TRADEMARK OFFICE

CERTIFICATE OF CORRECTION

PATENT NO. : 3,958,991

DATED : May 25, 1976

INVENTOR(S) : Jean Elmore Jones and William Edward Yoerger

It is certified that error appears in the above-identified patent and that said Letters Patent are hereby corrected as shown below:

Column 2, line 6, "a new material" should read --new materials--.
Column 4, line 66, that part of formula reading:

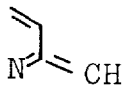

should read

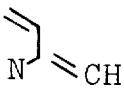

.

Column 5, line 9, that part of formula reading:

C-CH-CH=C should read C=CH-CH=C ;

line 27, that part of formula reading:

C-CH-C(Me)=C should read C=CH-C(Me)=C ;

line 55, that part of formula reading:

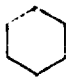

should read

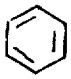

.

UNITED STATES PATENT AND TRADEMARK OFFICE

CERTIFICATE OF CORRECTION

PATENT NO. : 3,958,991

DATED : May 25, 1976

INVENTOR(S) : Jean Elmore Jones and William Edward Yoerger

It is certified that error appears in the above-identified patent and that said Letters Patent are hereby corrected as shown below:

Column 6, line 4, that part of formula reading:

-N=Et should read -N-Et ;

line 23, that part of formula reading:

C-CH-CH=C should read C=CH-CH=C ;

line 30, that part of formula reading:

CO——N- should read O=C——N- .

Column 13, line 54, "therefore" should read --therefor--. Column 14, line 31, "therefore" should read --therefor--; line 53, "3,3'-diethyloxacarboxyanine" should read --3,3'-diethyloxacarbocyanine --. Column 15, line 7, "2-diphenylpyrylium" should read --2-phenylpyrylium--. Column 16, line 34, that part of formula reading "piperidino)" should read --piperidino)benzo--; line 64, that part of formula reading "(N-" should read -- (N-n- --.

Signed and Sealed this

Sixteenth Day of November 1976

[SEAL]

*Attest:*

RUTH C. MASON
*Attesting Officer*

C. MARSHALL DANN
*Commissioner of Patents and Trademarks*